US010935349B1

(12) United States Patent
Hower

(10) Patent No.: US 10,935,349 B1
(45) Date of Patent: Mar. 2, 2021

(54) DEFEAT SYSTEM FOR VEHICLE ATTACHED IMPROVISED EXPLOSIVE DEVICES

(71) Applicant: HONEYWELL FEDERAL MANUFACTURING & TECHNOLOGIES, LLC, Kansas City, MO (US)

(72) Inventor: Brent Hower, Kansas City, MO (US)

(73) Assignee: Honeywell Federal Manufacturing & Technologies, LLC, Kansas City, MO (US)

( * ) Notice: Subject to any disclaimer, the term of this patent is extended or adjusted under 35 U.S.C. 154(b) by 0 days.

(21) Appl. No.: 16/390,581

(22) Filed: Apr. 22, 2019

Related U.S. Application Data

(63) Continuation of application No. 15/692,632, filed on Aug. 31, 2017, now Pat. No. 10,267,600.

(60) Provisional application No. 62/383,102, filed on Sep. 2, 2016.

(51) Int. Cl.
*F41H 5/06* (2006.01)
*F41H 5/007* (2006.01)
*F41H 7/00* (2006.01)

(52) U.S. Cl.
CPC ..... *F41H 5/007* (2013.01); *F41H 7/00* (2013.01)

(58) Field of Classification Search
CPC ..... F41H 7/00; F41H 7/042; F41H 5/007
USPC ..... 89/36.01–36.17
See application file for complete search history.

(56) References Cited

U.S. PATENT DOCUMENTS

| | | | | |
|---|---|---|---|---|
| 5,739,458 | A * | 4/1998 | Girard | F41H 9/00 89/36.02 |
| 5,810,427 | A * | 9/1998 | Hartmann | B60R 19/40 280/742 |
| 6,749,218 | B2 * | 6/2004 | Breed | B60R 21/013 280/735 |
| 7,421,936 | B2 * | 9/2008 | Barger | F41H 5/007 86/50 |
| 7,639,178 | B1 * | 12/2009 | Mulbrook | G01S 7/35 342/127 |
| 8,594,979 | B2 * | 11/2013 | Icove | G01V 3/081 702/189 |
| 9,539,974 | B2 * | 1/2017 | Fukuda | B60R 21/213 |
| 2007/0057490 | A1 * | 3/2007 | Deflorimonte | B60R 19/205 280/730.1 |
| 2014/0332305 | A1 * | 11/2014 | Thomas | B60R 21/34 180/274 |
| 2015/0233678 | A1 * | 8/2015 | Smith | F41H 1/02 89/36.02 |
| 2015/0316358 | A1 * | 11/2015 | Ali | E04C 5/012 52/1 |

* cited by examiner

*Primary Examiner* — Dennis H Pedder
(74) *Attorney, Agent, or Firm* — Hovey Williams LLP

(57) ABSTRACT

An explosive device detection and expulsion system broadly comprising a detection subsystem for sensing an IED attached to a vehicle and an expulsion subsystem for expelling the IED from the vehicle. The detection subsystem includes a sensor for detecting an IED via an electromagnetic field change or capacitance change, vibrations, and/or heat, and a controller for activating the expulsion subsystem upon receiving a detection signal from the sensor. The expulsion subsystem includes a deployable panel configured to be attached to the vehicle and a deployable mechanism for shifting the deployable panel from an undeployed state to a deployed state so as to expel the IED from the vehicle.

17 Claims, 2 Drawing Sheets

DEFEAT SYSTEM FOR VEHICLE ATTACHED IMPROVISED EXPLOSIVE DEVICES

RELATED APPLICATIONS

This regular utility non-provisional patent application is a continuation and claims priority benefit with regard to all common subject matter of earlier-filed non-provisional U.S. patent application Ser. No. 15/692,632, filed on Aug. 31, 2017, and entitled "DEFEAT SYSTEM FOR VEHICLE ATTACHED IMPROVISED EXPLOSIVE DEVICES." application Ser. No. 15/692,632 claims priority benefit with regard to all common subject matter of provisional U.S. Patent Application Ser. No. 62/383,102, filed on Sep. 2, 2016, and entitled "DEFEAT SYSTEM FOR VEHICLE ATTACHED IMPROVISED EXPLOSIVE DEVICES." The identified earlier-filed patent applications are hereby incorporated by reference in their entireties into the present application.

STATEMENT REGARDING FEDERALLY-SPONSORED RESEARCH OR DEVELOPMENT

This invention was made with Government support under Contract No.: DE-NA0000622 awarded by the United States Department of Energy/National Nuclear Security Administration. The Government has certain rights in the invention.

BACKGROUND

Terrorists often attempt to attach improvised explosive devices (IEDs) to target vehicles while the vehicles are in motion. The IEDs are typically attached to the vehicles via adhesives or magnets. The vehicle occupants are usually unaware that an IED has been attached to their vehicle and thus are not warned to flee the vehicle or to follow an imminent explosion protocol. Some vehicles are fitted with IED deterrent systems that prevent or hinder IEDs from being attached thereto. For example, custom fabricated body components make it difficult to attach an IED to a vehicle. Non-magnetic panels prevent IEDs from being magnetically attached to a vehicle. Unfortunately, existing IED deterrent systems are ineffective against some IEDs and provide no protection against IEDs that are successfully attached to the vehicle. Many existing IED deterrent systems are also impractical and expensive. Other IED defense mechanisms include counter explosion systems that create a directed reactionary explosion that mitigates the harmful effects of the IED's explosion. However, counter explosion systems do not fully protect the vehicle occupants and do not prevent the vehicle from being destroyed.

SUMMARY

Embodiments of the present invention solve the above-described and other problems and limitations by providing an explosive device detection and expulsion system that expels IEDs and other explosive devices, tracking devices, and other foreign objects from a vehicle upon detecting the devices. The explosive device detection and expulsion system can be used with personal, commercial, or military vehicles including all-purpose vehicles, trailers, tanks, sea vessels, aircraft, and unmanned vehicles. The explosive device detection and expulsion system broadly comprises a detection subsystem and an expulsion subsystem.

The detection subsystem broadly comprises a number of sensors, a controller, and a transceiver. The sensors detect IEDs and other foreign objects placed on a vehicle. The sensors may be electromagnetic sensors, vibration sensors, heat sensors, or any other suitable sensors. In one embodiment, the sensors detect magnetic or electrical changes or heat near body panels or other parts of the vehicle. Alternatively, the sensors may detect vibrations or capacitance changes in or on the body panels or other parts of the vehicle. At least one of the sensors is configured to communicate a detection signal to the controller via wired connection or wirelessly via radio frequency RF transmissions, Bluetooth signal, or any other suitable wireless communication medium. To that end, at least one of the sensors may include or may be an antenna or transceiver for communicating wirelessly with the controller. The sensors may be incorporated into components of the expulsion subsystem or may be configured to be mounted separately on the vehicle.

The controller generates an expulsion trigger signal upon receiving the detection signal(s) from the sensors and sends the expulsion trigger signal to the expulsion subsystem. The controller may include computing components such as a processor, memory, power components, and communication components for communicating with the sensors, expulsion subsystem, and external systems. The controller may be incorporated into the vehicle's control system or a deployable panel of the expulsion subsystem or may be an external or stand-alone component.

The transceiver is coupled with the controller and transmits an alert to the driver of the vehicle, the vehicle's control system, or a remote monitoring system that an IED or other foreign object has been attached to and/or expelled from the vehicle. The transceiver may also transmit and receive signals between the sensors and controller.

The expulsion subsystem broadly comprises a number of deployable panels and a number of deploying mechanisms. The deployable panels expel IEDs and other foreign objects attached to the vehicle. The deployable panels may be inflatable thin film membranes or inflatable bags each including an outer wall defining an inner chamber. The outer wall may be thin and flexible yet airtight for allowing rapid expansion of the inner chamber. The inner chamber may be in fluid communication with one of the deploying mechanisms via an opening for allowing gas to flow from the deploying mechanism into the inner chamber. Alternatively, the outer wall may be closed off with the deploying mechanism in the inner chamber. The deployable panels may be decals configured to be adhesively attached to a body panel of the vehicle or may be formed of heat-sensitive material for being shrink-wrapped onto a vehicle body panel. To that end, each deployable panel may have a shape corresponding to a shape of the body panel to which it is being attached. The deployable panels may also be removable from the body panels for when the deployable panels are no longer needed.

The deploying mechanisms shift the deployable panels from an undeployed state to a deployed state upon receiving an expulsion trigger signal from the controller. The deploying mechanisms may be gas canisters filled with compressed carbon dioxide, nitrogen, or other suitable gas. Alternatively, the deploying mechanisms may be chemical igniters configured to initiate a rapidly expanding chemical reaction. For example, the chemical igniters may be configured to generate an electrical spark so as to react sodium azide ($NaN_3$) and/or other chemicals into nitrogen gas ($N_2$) and/or other expanded gases.

In use, the explosive device detection and expulsion system may be installed on a vehicle in the field or may be factory built into the vehicle. For example, the deployable panels may be attached to body panels of the vehicle by unskilled or non-expert individuals without extensive training and with minimal preparation. Each deployable panel may be attached to a particular body panel or part of the vehicle according to the deployable panel's shape. For example, an L-shaped deployable panel may be attached to a quarter panel of the vehicle while a rectangular deployable panel may be attached to the vehicle's tailgate. Deployable decal panels may be adhesively attached to the body panels much like conventional vehicle decals. deployable shrink wrap panels may be positioned against body panels and subjected to heat so that the deployable shrink wrap panels cling to the body panels.

The sensors may be incorporated into the deployable panels or may be mounted separately on the vehicle for improved sensitivity. The controller may be mounted in the cab or other central location of the vehicle for communicating with the sensors and deploying mechanisms.

Detection and expulsion of an IED via one of the deployable panels will now be described. The sensor corresponding to the deployable panel senses an electromagnetic field change, an electrical property change, vibrations, and/or heat originating from the IED either by its presence or from the IED being attached to the vehicle. The sensor then transmits a detection signal to the controller indicating that an IED or other foreign object has been detected.

The controller then generates an expulsion trigger signal and transmits it to the corresponding deploying mechanism upon receiving the detection signal. To that end, the controller may determine that the detection signal originated from a tailgate sensor, for example, and thus transmits the expulsion trigger signal only to the tailgate deploying mechanism. In this way, only the necessary deploying mechanism is activated.

Upon receiving the expulsion trigger signal from the controller, the deploying mechanism shifts the deployable panel from the undeployed state to the deployed state. For example, the deploying mechanism may release compressed gas into the inner chamber of the deployable panel so as to inflate the deployable panel. Alternatively, the deploying mechanism may initiate a rapidly expanding chemical reaction so as to inflate the deployable panel. In this way, the rapidly expanding deployable panel forces the IED from the vehicle. To that end, the impulse expelling the IED or other foreign object must be greater than the magnetic and/or adhesive reaction impulse retaining the IED on the vehicle.

The controller may also instruct the transceiver to transmit an alert or other notification to the driver of the vehicle, the vehicle's control system, or a remote monitoring system that an IED or other foreign object has been attached to and/or expelled from the vehicle.

The above-described explosive device detection and expulsion system provides several advantages over conventional IED deterrent systems. For example, the explosive detection and expulsion system expels IEDs and other foreign objects that are attached to a vehicle via magnets and adhesives. The explosive detection and expulsion system expels IEDs and other explosives upon detection, thus preventing them from causing harm to the vehicle occupants and causing damage to the vehicle.

The explosive device detection and expulsion system can be installed on a vehicle in the field without extensive training and with minimal preparation. The explosive device detection and expulsion system can also be easily removed from the vehicle when the explosive device detection and expulsion system is no longer needed. The explosive device detection and expulsion system is readily adapted to and installed on a wide variety of vehicles and vehicle panels. For example, the deployable panels can have virtually any shape corresponding to different vehicle panels, sections, and parts. The explosive device detection and expulsion system provides autonomous and active IED monitoring and expulsion. The controller also alerts the driver, the vehicle's control system, or a remote monitoring system that an IED or other foreign object has been attached to and/or expelled from the vehicle.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the preferred embodiments and the accompanying drawing figures.

Figure 1:
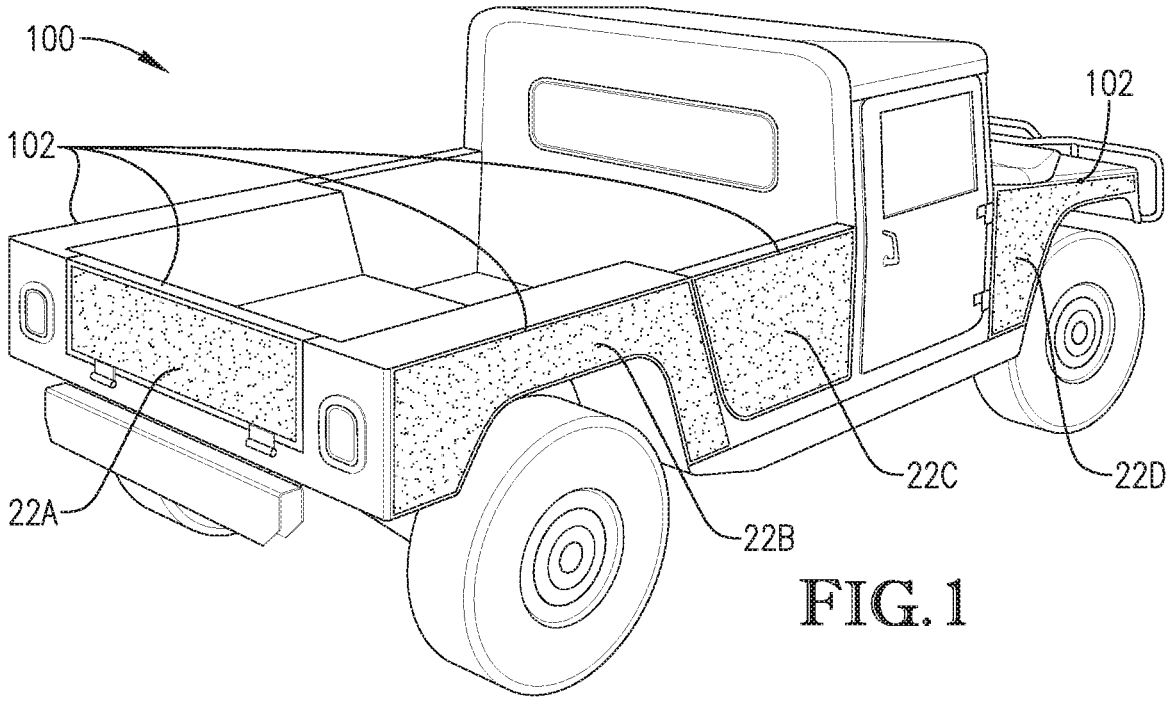
FIG. 1 is a perspective view of a vehicle on which a plurality of deployable panels of an explosive device detection and expulsion system constructed in accordance with an embodiment of the invention are mounted.
Figure 2A:
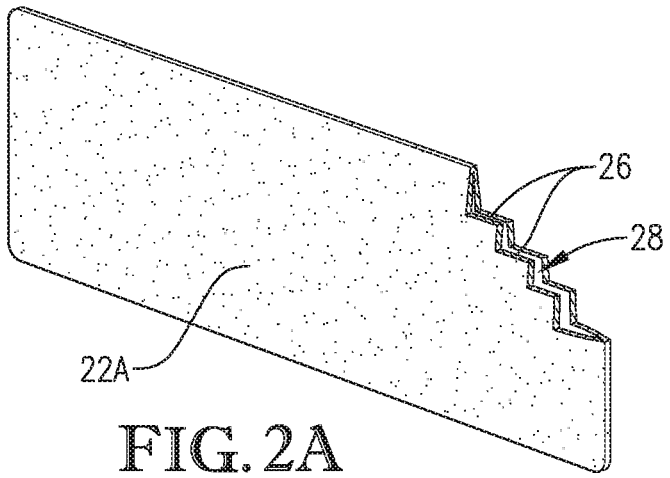
FIG. 2A is a partial cutaway perspective view of a deployable panel in an undeployed state.
Figure 2B:
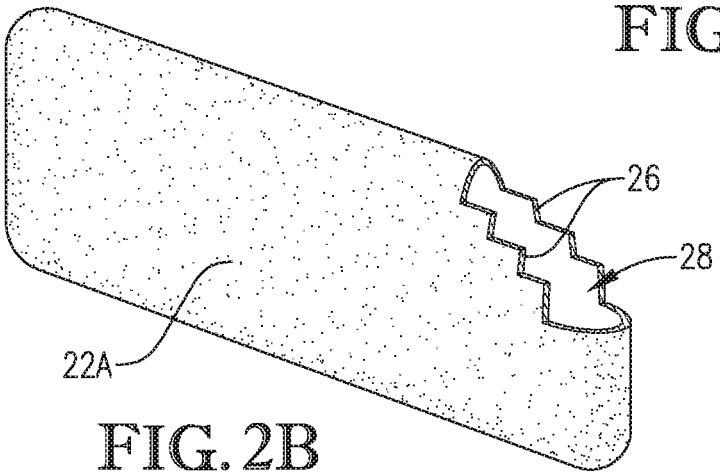
FIG. 2B is a partial cutaway perspective view of the deployable panel of FIG. 2A in a deployed state.
Figure 3:
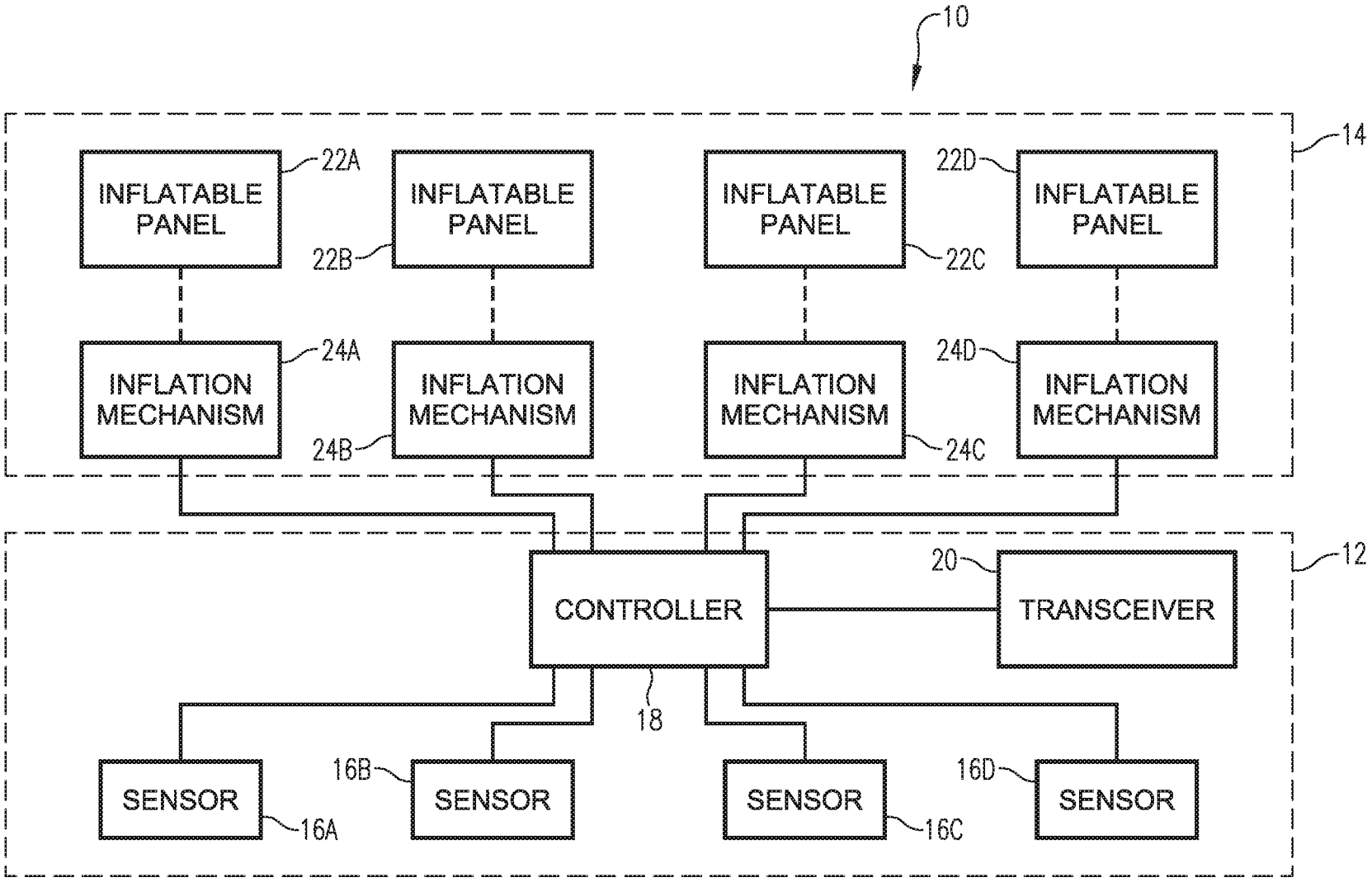
FIG. 3 is a schematic diagram of an explosive device detection and expulsion system.

The drawing figures do not limit the present invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning now to the drawing figures, an explosive device detection and expulsion system 10 broadly comprising a detection subsystem 12 and an expulsion subsystem 14 is illustrated. The explosive device detection and expulsion system 10 can be used with personal, commercial, or military vehicles including all-purpose vehicles, trailers, tanks, sea vessels, aircraft, and unmanned vehicles for detecting and expelling IEDs and other explosive devices, tracking devices, and other foreign objects.

The detection subsystem 12 broadly comprises a plurality of sensors 16A-D, a controller 18, and a transceiver 20. Although only four sensors 16A-D are shown, it will be understood that any number of sensors may be provided. The sensors 16A-D detect IEDs and other foreign objects attached to a vehicle 100 and are essentially identical so only sensor 16A will be described in detail. Sensor 16A may be an electromagnetic sensor, vibration sensor, heat sensor, or any other suitable sensor. For example, sensor 16A may detect magnetic or electrical changes or heat near body panels 102 or other vehicle parts. Alternatively, sensor 16A may detect vibrations or capacitance changes in or on the body panels 102 or other vehicle parts. The sensor 16A may communicate a detection signal to the controller 18 via wired connection or wirelessly via radio frequency RF transmissions, Bluetooth signal, or any other suitable wireless communication medium. To that end, the sensor 16A may include or may be an antenna or transceiver for communicating wirelessly with the controller 18. The sensor 16A may be incorporated into components of the expulsion subsystem 14 or may be configured to be mounted separately on the vehicle 100.

The controller 18 activates the expulsion subsystem 14 via an expulsion trigger signal and instructs the transceiver 20 to transmit an alert and/or other signals upon receiving a detection signal from one or more of the sensors 16A-D. The controller 18 may include computing components such as a processor, memory, power components, and communication components for communicating with the sensors 16A-D, expulsion subsystem 14, and external systems. The controller 18 may be incorporated into the vehicle's control system or a deployable panel of the expulsion subsystem 14 or may be an external or stand-alone component. The controller 18 may run a computer program stored in or on computer-readable medium residing on or accessible by the controller 18. The computer programs preferably comprises ordered listings of executable instructions for implementing logical functions in the controller 18. The computer programs can be embodied in any computer-readable medium for use by or in connection with an instruction execution system, apparatus, or device, such as a computer-based system, processor-containing system, or other system that can fetch the instructions from the instruction execution system, apparatus, or device, and execute the instructions. In the context of this document, a "computer-readable medium" can be any means that can contain, store, communicate, propagate, or transport the program for use by or in connection with the instruction execution system, apparatus, or device. The computer-readable medium can be, for example, but is not limited to, an electronic, magnetic, optical, electromagnetic, infrared, or semi-conductor system, apparatus, device, or propagation medium. More specific, although not inclusive, examples of the computer-readable medium would include the following: an electrical connection having one or more wires, a portable computer diskette, a random access memory (RAM), a read-only memory (ROM), an erasable, programmable, read-only memory (EPROM or flash memory), an optical fiber, and a portable compact disk read-only memory (CDROM). The computer-readable medium may be one or more components incorporated into the motor controller 18.

The memory of the controller 18 may include, for example, removable and non-removable memory elements such as RAM, ROM, flash, magnetic, optical, USB memory devices, and/or other conventional memory elements. The memory may store various data associated with the controller 18, such as the computer program and code segments mentioned above, or other data for instructing the controller 18 to perform the steps described herein. Further, the memory may store data retrieved form the controller 18.

The transceiver 20 is coupled with the controller 18 and transmits an alert to the driver of the vehicle 100, the vehicle's control system, or a remote monitoring system that an IED or other foreign object has been attached to and/or expelled from the vehicle 100. The transceiver 20 may also transmit and receive signals between the sensors 16A-D and controller 18.

The expulsion subsystem 14 broadly comprises a plurality of deployable panels 22A-D and a plurality of deploying mechanisms 24A-D. Although only four deployable panels 22A-D are shown, it will be understood that any number of deployable panels may be provided. The deployable panels 22A-D expel IEDs and other foreign objects attached to the vehicle 100 and are essentially identical (except in shape and position on the vehicle 100) so only deployable panel 22A will be described in detail. The deployable panel 22A may be an inflatable thin film membrane or inflatable bag including an outer wall 26 defining an inner chamber 28. The outer wall 26 may be thin and flexible yet airtight for allowing rapid expansion of the inner chamber 28. The inner chamber 28 may be in fluid communication with the deploying mechanism 24A via an opening for allowing gas to flow from the deploying mechanism 24A into the inner chamber 28. Alternatively, the outer wall 26 may be closed off with the deploying mechanism 24A in the inner chamber 28. The deployable panel 22A may be a decal configured to be adhesively attached to a body panel 102 of the vehicle 100 or may be formed of heat-sensitive material for being shrink-wrapped onto a body panel 102. To that end, the deployable panel 22A may have a shape corresponding to a shape of the body panel 102 to which it is being attached. The deployable panel 22A may also be removable from the body panel 102 for when the deployable panel 22A is no longer needed.

Although only four deploying mechanisms 24A-D are shown, it will be understood that any number of deploying mechanisms may be provided. The deploying mechanisms 24A-D shift the deployable panels 22A-D from an undeployed state to a deployed state upon receiving an expulsion trigger signal from the controller 18 and are essentially identical so only deploying mechanism 24A will be described in detail. The deploying mechanism 24A is connected to the deployable panel 22A and may be a gas canister filled with compressed carbon dioxide, nitrogen, or other suitable gas. Alternatively, the deploying mechanism 24A may be a chemical igniter configured to initiate a rapidly expanding chemical reaction. For example, the chemical igniter may be configured to generate an electrical spark so as to react sodium azide ($NaN_3$) and/or other chemicals into nitrogen gas ($N_2$) and/or other expanded gases.

In use, the explosive device detection and expulsion system 10 may be installed on a vehicle in the field or may be factory built into the vehicle. For example, the deployable panels 22A-D may be attached to body panels 102 of the vehicle 100 by unskilled or non-expert individuals without extensive training and with minimal preparation. Each deployable panel 22A-D may be attached to a particular body panel 102 or vehicle part according to the deployable panel's shape. For example, an L-shaped deployable panel may be attached to a quarter panel of the vehicle 100 while a rectangular deployable panel may be attached to the vehicle's tailgate. Deployable decal panels may be adhesively attached to the body panels 102 much like conventional vehicle decals. Deployable shrink wrap panels may be positioned against body panels 102 and subjected to heat so that the deployable shrink wrap panels cling to the body panels 102.

The sensors 16A-D may be incorporated into the deployable panels 22A-D or may be mounted separately on the vehicle 100 for improved sensitivity. The controller 18 may be mounted in the cab or other central location of the vehicle 100 for communicating with the sensors 16A-D and deploying mechanisms 24A-D.

Detection and expulsion of an IED via deployable panel 22A will now be described in detail. The sensor 16A senses an electromagnetic field change, an electrical property change, vibrations, and/or heat originating from the IED either by the IED's presence or from the IED being attached to the vehicle 100. The sensor 16A then transmits a detection signal to the controller 18 indicating that an IED or other foreign object has been detected.

The controller 18 generates an expulsion trigger signal and transmits it to the deploying mechanism 24A upon receiving the detection signal. To that end, the controller 18 may determine that the detection signal originated from sensor 16A and thus transmits the expulsion trigger signal only to the deploying mechanism 24A. In this way, only the necessary deploying mechanism is activated. In some embodiments, the controller 18 may only generate an expulsion trigger signal if a predetermined criterion or set of criteria are met such that false detections and faulty sensors do not trigger the deploying mechanism 24A. For example, the controller 18 may generate an expulsion trigger signal only if the detection signal is above a threshold voltage or other signal strength or if the electromagnetic field change sensed by the sensor 16A matches an IED profile.

Upon receiving the expulsion trigger signal from the controller 18, the deploying mechanism 24A shifts the deployable panel 22A from the undeployed state to the deployed state. For example, the deploying mechanism 24A may release compressed gas into the inner chamber 28 of the deployable panel 22A so as to inflate the deployable panel 22A. Alternatively, the deploying mechanism 24A may initiate a rapidly expanding chemical reaction so as to inflate the deployable panel 22A. In this way, the rapidly expanding deployable panel 22A forces the IED from the vehicle 100. To that end, the impulse expelling the IED or other foreign object must be greater than the magnetic and/or adhesive reaction impulse retaining the IED on the vehicle 100.

The controller 18 may also instruct the transceiver 20 to transmit an alert or other notification to the driver of the vehicle 100, the vehicle's control system, or a remote monitoring system that an IED or other foreign object has been attached to and/or expelled from the vehicle 100.

The above-described explosive device detection and expulsion system 10 provides several advantages over conventional IED deterrent systems. For example, the explosive detection and expulsion system 10 expels IEDs and other foreign objects that are attached to a vehicle via magnets and adhesives. The explosive detection and expulsion system 10 expels IEDs and other explosives upon detection, thus preventing them from causing harm to the vehicle occupants and causing damage to the vehicle 100.

The explosive device detection and expulsion system 10 can be installed on the vehicle 100 in the field without extensive training and with minimal preparation. The explosive device detection and expulsion system 10 can also be easily removed from the vehicle 100 when the explosive device detection and expulsion system 10 is no longer needed. The explosive device detection and expulsion system 10 is readily adapted to and installed on a wide variety of vehicles and vehicle panels. For example, the deployable panels 22A-D can have virtually any shape corresponding to different vehicle panels, sections, and parts. The explosive device detection and expulsion system 10 provides autonomous and active IED monitoring and expulsion. The controller 18 also alerts the driver, the vehicle's control system, or a remote monitoring system that an IED or other foreign object has been attached to and/or expelled from the vehicle 100.

Although the invention has been described with reference to the exemplary embodiments illustrated in the attached drawings, it is noted that equivalents may be employed and substitutions made herein without departing from the scope of the invention as recited in the claims. For example, while the explosive device detection and expulsion system 10 has been described as a complete vehicle protection system with a central controller 18, it will be understood that a plurality of explosive device detection and expulsion systems, each with their own sensor, deployable panel, deploying mechanism, and/or controller, may be utilized on a single vehicle. In some embodiments, detection and expulsion can be performed without a dedicated controller. For example, the sensor 16A may close or open an electric circuit or create a triggering voltage upon detecting an IED or other foreign object so as to directly activate the deploying mechanism 24A.

Having thus described various embodiments of the invention, what is claimed as new and desired to be protected by Letters Patent includes the following:

1. An explosive device expulsion system for a vehicle having a plurality of body panels, the explosive device expulsion system comprising:

a deployable panel configured to be attached to one of the plurality of body panels, the deployable panel having a shape corresponding to a shape of the one of the plurality of body panels;

a sensor configured to detect an explosive device attached to the vehicle and transmit a detection signal indicating that an explosive device has been detected; and a deploying mechanism configured to shift the deployable panel from an undeployed state to a deployed state when the expulsion system receives an expulsion trigger signal via the sensor so that the deployable panel expels the explosive device from the vehicle.

2. The explosive device expulsion system of claim 1, further comprising a plurality of deployable panels, each deployable panel being configured to be positioned on a different one of the plurality of body panels.

3. The explosive device expulsion system of claim 2, wherein the deployable panels have at least two different shapes.

4. The explosive device expulsion system of claim 1, wherein the deployable panel has an L-shape for being attached to a vehicle quarter panel.

5. The explosive device expulsion system of claim 1, wherein the deployable panel has a rectangular shape for being attached to a tailgate.

6. The explosive device expulsion system of claim 1, wherein the deployable panel is an inflatable bag having an outer wall defining an inner chamber, the deploying mechanism being configured to fill the inner chamber with gas so as to shift the deployable panel to the deployed state.

7. The explosive device expulsion system of claim 6, wherein the deploying mechanism is configured to fill the inner chamber via compressed gas.

8. The explosive device expulsion system of claim 6, wherein the deploying mechanism is configured to fill the inner chamber with gas via a chemical reaction.

9. The explosive device expulsion system of claim 6, wherein the inner chamber is in fluid communication with the deploying mechanism.

10. The explosive device expulsion system of claim 6, wherein the outer wall is closed off and the deploying mechanism is positioned in the inner chamber.

11. The explosive device expulsion system of claim 1, wherein the deployable panel is formed of heat-sensitive material.

12. An explosive device expulsion system for a vehicle having a plurality of body panels, the explosive device expulsion system comprising:

a plurality of deployable panels configured to be attached to the plurality of body panels, each deployable panel having a shape corresponding to a shape of one of the plurality of body panels;

a sensor configured to detect an explosive device attached to the vehicle and transmit a detection signal indicating that an explosive device has been detected; and a plurality of deploying mechanisms each configured to shift one of the plurality of deployable panels from an undeployed state to a deployed state when the expulsion system receives an expulsion trigger signal via the sensor so that the one of the plurality of deployable panels expels the explosive device from the vehicle.

13. The explosive device expulsion system of claim 12, wherein the deployable panels have at least two different shapes.

14. The explosive device expulsion system of claim 12, wherein at least two of the plurality of deployable panels have an L-shape for being attached to left and right vehicle quarter panels.

15. The explosive device expulsion system of claim 12, wherein one of the plurality of deployable panels has a rectangular shape for being attached to a tailgate.

16. The explosive device expulsion system of claim 12, wherein the deployable panels are inflatable bags or inflatable films each having an outer wall defining an inner chamber, the deploying mechanisms each being configured to fill one of the inner chambers with gas so as to shift the deployable panel to the deployed state.

17. An explosive device expulsion system for a vehicle having a plurality of body panels including quarter panels and a tailgate, the explosive device expulsion system comprising:

a plurality of deployable panels configured to be removably attached to the plurality of body panels, each deployable panel being an inflatable bag or inflatable film having an outer wall defining an inner chamber, at least two of the deployable panels having an L-shape for being attached to the quarter panels, one of the deployable panels being rectangular for being attached to the tailgate, the deployable panels being formed of heat sensitive material;

a plurality of electromagnetic sensors each configured to detect an explosive device attached to the vehicle and transmit a detection signal indicating that an explosive device has been detected; and a plurality of deploying mechanisms, each being configured to fill the inner chamber of one of the plurality of deployable panels with gas so as to shift the deployable panel to a deployed state when the expulsion system receives an expulsion trigger signal via the sensor so that the deployable panel expels the explosive device from the vehicle.

* * * * *